United States Patent [19]

Witczak

[11] Patent Number: 4,569,284

[45] Date of Patent: Feb. 11, 1986

[54] SHEET HANDLING MECHANISM FOR DUPLICATING MACHINE WITH DUPLEXING CAPABILITY

[75] Inventor: Stanley Witczak, Chicago, Ill.

[73] Assignee: AM International, Chicago, Ill.

[21] Appl. No.: 714,568

[22] Filed: Mar. 21, 1985

[51] Int. Cl.[4] ..... B41F 5/16

[52] U.S. Cl. ..... 101/183; 271/186; 271/206; 271/277; 198/375

[58] Field of Search ..... 101/177, 183, 184, 136–137, 101/142, 153, 217–218, 251; 271/184–186, 204, 206, 277; 198/373, 375–379, 394, 404, 411–412

[56] References Cited

U.S. PATENT DOCUMENTS

| | | | |
|---|---|---|---|
| 267,171 | 11/1882 | Feister | 198/375 |
| 936,151 | 10/1909 | North | 271/277 |
| 1,429,327 | 9/1922 | Daniell | 271/186 X |
| 1,693,272 | 11/1928 | Elsas et al. | 271/186 X |
| 2,705,918 | 4/1955 | Koch | 101/183 |
| 2,895,588 | 7/1959 | Van Marle | 198/376 |
| 3,744,415 | 7/1973 | Ras | 101/177 |
| 3,783,991 | 1/1974 | McCahon et al. | 198/377 |
| 3,853,315 | 12/1974 | Dahlgren | 271/204 |
| 4,408,525 | 10/1983 | Rebel | 101/183 |

*Primary Examiner*—E. H. Eickholt

*Attorney, Agent, or Firm*—Nicholas A. Camasto

[57] ABSTRACT

A sheet handling mechanism for use in a duplicating machine for duplicating images on both sides of copy sheets including a first printing couple for transferring a first image to a first side of a copy sheet and a second printing couple for transferring a second image to a second side of the sheet. The sheet handling mechanism includes a conveyor movable between the first and second printing couples. Gripper mechanism are operatively associated with the conveyor for gripping the lead end of a copy sheet issuing from the first printing couple and rotating the sheet about an axis generally parallel to the direction of movement of the conveyor to present the second side of the sheet, lead end first, to the second printing couple.

14 Claims, 2 Drawing Figures

FIG. 1
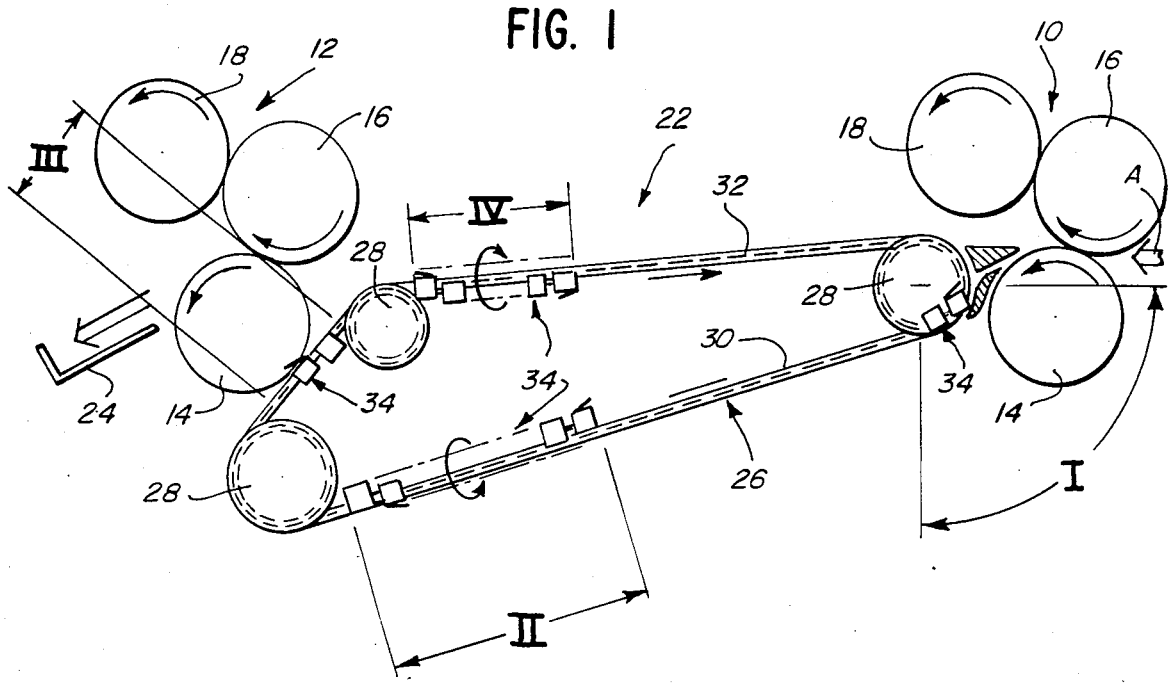
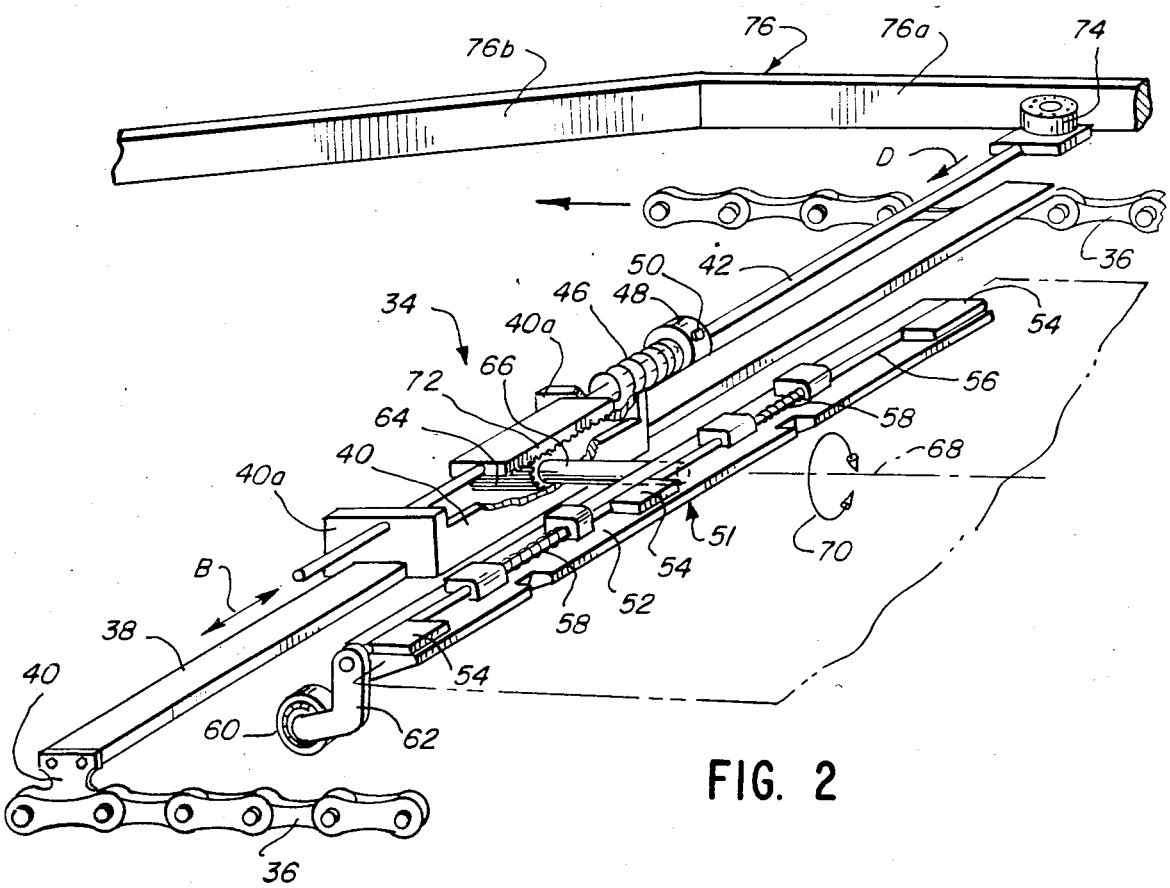
FIG. 2

SHEET HANDLING MECHANISM FOR DUPLICATING MACHINE WITH DUPLEXING CAPABILITY

BACKGROUND OF THE INVENTION

This invention relates generally to a duplicating machine and, more particularly, to a machine for duplicating images on both sides of copy sheets, hereinafter sometimes referred to as "duplexing".

Duplicating machines are available for the production of copies with images formed on one side of the copy sheets. Such equipment can be reliably operated at highly satisfactory production rates. Because of the advantages of duplexing in savings of the amount of paper employed, savings in the space occupied by the copies produced, and savings in production time and equipment costs, it is desirable to provide apparatus for imaging both sides of a copy sheet.

Duplexing often is effected by duplicating machines employing a single printing couple to thereby provide a compact unit that may be utilized in small work areas and conserve the amount of floor space required in which to operate the equipment. However, single printing couples for duplex printing require relatively large and expensive master cylinders, blanket cylinders and impression cylinders because of the multiple images required on a single cylinder. Sometimes the cost is prohibitive. In addition, relatively complex gripper mechanisms are required on the impression cylinder, as well as complex mechanisms for handling sheets released from the impression cylinder and re-feeding the sheets back to the gripper mechanisms on the cylinder.

Consequently, it often is desirable to utilize plural printing couples employing less expensive cylinders and gripper mechanisms where the work area or floor space in which the mechanism is to be utilized is not a premium. There have been various approaches in the printing and duplicating field for printing a copy sheet on a first side by a first printing couple and then on the opposite side by a second printing couple.

One approach to such duplex printing has been to provide a sheet handling mechanism for passing a copy sheet through a first printing couple for imaging one side of the sheet in a first direction and advancing the sheet in a second, substantially perpendicular direction to a second printing couple. As the sheet changes direction, it is inverted by a turn-over device and simultaneously directed to the second printing couple for imaging the opposite side of the sheet. Such machines have an L-shaped configuration of the sheet advancing path and are considerably more expensive and complex than simple straight-line, tandemly arranged printing apparatus.

Therefore, the most prominent approach in the printing and duplicating field has been to print a copy sheet on a first side by a first printing couple and then on the opposite side by a second, tandemly arranged printing couple. Such tandemly arranged machines still have considerable problems in alignment, timing and other sheet parameters because the sheet most often is grasped at a lead edge when issuing from the first printing couple and then fed to the second printing couple whereat the opposite or trail edge of the sheet must be grasped in precise alignment and under strict timing conditions.

This invention is directed to solving such sheet handling problems, primarily in printing or duplicating machine arrangements utilizing tandemly arranged printing couples.

SUMMARY OF THE INVENTION

An object, therefore, of the invention is to provide a new and improved mechanism for handling copy sheets for duplexing images in a duplicating machine.

Another object of the invention is to provide a sheet handling mechanism in a duplicating machine employing printing couples arranged in tandem.

A further object of the invention is to provide a sheet handling mechanism of the character described for engaging the lead end of a copy sheet issuing from a first printing couple, rotating the sheet and feeding the same lead end of the sheet to the second printing couple for duplexing images on both sides of the sheet.

In the exemplary embodiment of the invention, a sheet handling mechanism is provided for duplexing images on both sides of a copy sheet in a duplicating machine including a first printing couple for transferring a first image to a first side of the copy sheet and a second printing couple for transferring a second image to a second side of the sheet. Generally, conveyor means are disposed and movable between the first and second printing couples. Gripper means are operatively associated with the conveyor means for gripping the lead end of a copy sheet issuing from the first printing couple and rotating the sheet about an axis generally parallel to the direction of movement of the conveyor means to present the second side of the sheet to the second printing couple.

More particularly, the conveyor means comprise a pair of generally parallel, endless drive chains movable along forward and return runs between the first and second printing couples. A gripper bar is carried by a mounting bar disposed transversely between the drive chains. The gripper bar engages the lead end of a copy sheet as the sheet issues from the first printing couple. Rotating means are disposed between the gripper bar and the mounting bar for rotating the gripper bar and the sheet about an axis generally parallel to the direction of movement of the drive chains to present the second side of the sheet to the second printing couple, lead end first. Cam means are disposed at a predetermined location along the forward run of the drive chains, operatively associated with the rotating means, for effecting rotation of the gripper bar.

The rotating means include a pinion gear fixed to the gripper bar for rotating the same, and a ratchet gear in mesh with the pinion gear. The ratchet gear is movably mounted on the mounting bar and is connected to a cam follower. The cam follower engages the cam means for longitudinally moving the ratchet gear and rotating the pinion gear. The pinion gear is disposed on an axis coincident with a central axis in the plane of a copy sheet engaged by the gripper bar.

Second cam means are located along the return run of the drive chains for rotating the gripper bar back to its original position for engaging the lead end of a subsequent copy sheet issuing from the first printing couple.

With such an arrangement, certain advantages are achieved. Since the lead end of the copy sheet always is engaged by the gripper bar during issuance from the first printing couple and during feeding to the second printing couple, there is no need for complex timing mechanisms and complex transfer gripping mechanisms to pick up the trail end of the sheet. Furthermore, since the lead end of the sheet is in constant engagement, there is no need for additional aligning mechanism when the sheet is inverted or reversed. The constant engagement of the lead end of the sheet also enables the same gripping mechanism to handle sheets of different sizes and/or lengths without adjustment.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a somewhat schematic elevation of the sheet handling mechanism disposed between a pair of printing couples; and FIG. 2 is a fragmented, perspective view, on an enlarged scale, of the sheet handling mechanism of this invention.

DETAILED DESCRIPTION OF THE PREFERRED EMBODIMENT

Referring to the drawings in greater detail, and first to FIG. 1, the sheet handling mechanism of this invention is illustrated for use in a duplicating machine for duplicating images on both sides of copy sheets. The duplicating machine includes a first printing couple, generally designated 10, and a second printing couple, generally designated 12, arranged in a straight-line or tandem configuration. Each printing couple includes an impression cylinder 14, a blanket cylinder 16 and a master cylinder 18. Copy sheets are fed seriatim in the direction of arrow A between the nip of impression cylinder 14 and blanket cylinder 16 of printing couple 10 for transferring a first image to a first side of the copy sheet. A sheet handling mechanism, generally designated 22 and incorporating the concepts of this invention, then moves each sheet from first printing couple 10 and feeds the sheet to impression cylinder 14 of second printing couple 12. The sheet passes through the nip between impression cylinder 14 and blanket cylinder 16 of second printing couple 12 for transferring a second image to a second side of the sheet. The duplexed sheet then is fed into a delivery tray 24.

Generally, sheet handling mechanism 22 includes conveyor means, generally designated 26, disposed and movable between first printing couple 10 and second printing couple 12. The conveyor means passes about a plurality of sprockets 28 to define a forward run 30 and a return run 32 of the conveyor means. Further, the sheet handling mechanism includes gripper means, generally designated 34, operatively associated with and moved by conveyor means 26 for gripping the lead end of a copy sheet issuing from first printing couple 10, rotating the sheet about an axis generally parallel to the direction of movement of the conveyor means, and feeding the sheet to second printing couple 12.

To this end, a plurality of gripper means 34 may be disposed along conveyor means 26 and be performing various functions simultaneously during operation of the machine. For instance, an area of operation is generally designated "I" to indicate the pick up area of a gripper means 34 for gripping the lead end of a copy sheet issuing from impression cylinder 14 of first printing couple 10. Area "II" indicates the area where the copy sheets are rotated to present the second side thereof to second printing couple 12. Area "III" indicates the area where the "reversed" copy sheets are picked up by impression cylinder 14 of second printing couple 12. Area "IV" indicates the area where the gripper means 34 are rotated back to their original positions for engaging copy sheets issuing from first printing couple 10, back at area "I".

Referring to FIG. 2, conveyor means 26 include a pair of generally parallel, endless drive chains 36 engaged about sprockets 28 and movable along the aforesaid forward and return runs 30 and 32, respectively, of the conveyor means between the first and second printing couples. Of course, as is known, sprockets 28 and, thus, conveyor chains 36 are driven in unison with operation of the first and second printing couples.

Each gripper means 34 include a mounting bar 38 extending transversely between drive chains 36. The mounting bar is secured at opposite ends to brackets 40 fixed at identical locations along the drive chains. Mounting bar 38 has a central bushing bracket 40 with end walls **40*a* through which a cam rod 42 is journalled. The cam rod is reciprocally movable lengthwise of the mounting bar, transversely of drive chains 36, as indicated by double-headed arrow "B". However, a coil spring 46 surrounds cam rod 42 and is held in compression against the right-hand (as viewed in the drawings) end wall 40*a* of bushing bracket 40 by means of a collar 48 on cam rod 42. A set screw 50 secures collar 48 to the cam rod and can be movably adjustable therealong to adjust the force of coil spring 46**.

Gripper means 34 further include a gripper bar, generally designated 51, for engaging the lead ends of the copy sheets issuing from first printing couple 10 and feeding the sheets to second printing couple 12. The gripper bar includes an elongated anvil 52 and a plurality of gripper fingers 54 for clamping a copy sheet between the anvil and the gripper fingers. The gripper fingers are fixed to a common rod 56 which is spring loaded by coil springs 58 to bias the gripper fingers into clamping engagement with the anvil. A cam roller 60 is secured by a roller arm 62 to one end of rod 56 to move the gripper fingers against the biasing of springs 58 for opening and closing the gripper bar for engaging and releasing the lead end of the copy sheets. Of course, cam roller 60 is operativey associated with appropriate cam actuators adjacent impression cylinders 14 of the printing couples as is known in the art of chain driven sheet handling mechanisms in duplicating machines.

Rotating means are provided between gripper bar 51 and mounting bar 38 for rotating an engaged copy sheet about an axis generally parallel to the direction of movement of drive chains 36. More particularly, a pinion gear 64 is fixed by a shaft 66 to anvil 52 of gripper bar 51. Shaft 66 is located precisely at the center of anvil 52 and, thus, gripper bar 51 to define an axis 68 of rotation as indicated by double-headed arrow 70. This axis is located coincident with a central axis of a copy sheet when engaged by gripper bar 51, the axis being located in the plane of the copy sheet. A ratchet gear 72 is fixed to cam rod 42, in mesh with pinion gear 64. The ratchet gear is movable longitudinally with the cam rod, transversely of drive chains 36, perpendicular to the direction of movement of the sheet handling mechanism and the engaged copy sheet.

A cam follower roller 74 is fixed to one end of cam rod 42 and is engageable with a cam bar 76. The cam bar is disposed at a predetermined location along forward run 30 (FIG. 1) of the conveyor means for effecting rotation of gripper bar 51. In other words, cam bar 76 is located in area "II" as indicated in FIG. 1. Cam bar 76 has a first portion 76*a* which extends generally parallel to drive chains 36. The cam bar has a second portion 76*b* inclined inwardly toward the drive chains and the sheet handling mechanism. Therefore, as the drive chains and sheet handling mechanism move in the direction of arrow "C" (FIG. 2), cam follower roller 74 will engage the inclined portion 76*b* of cam bar 76 and force cam rod 42 inwardly in the direction of arrow "D". The cam rod will move ratchet gear 72 therewith, causing rotation of pinion gear 64, and thereby effecting rotation of gripper bar 51 about central axis 68 to invert or reverse the copy sheet held thereby. As the copy sheet is moved to area "III" (FIG. 1), it can be seen that the copy sheet still is engaged at its lead end, and the lead end is fed to impression cylinder 14 of second printing couple 12. Since the sheet was rotated about its central axis, no further alignment of the sheet is necessary. Furthermore, no complicated mechanisms are required to grasp the trail end of the sheet as is prevalent in most sheet handling mechanisms in duplexing machines employing sheet conveyor means between tandemly arranged printing couples.

After each gripper means 34 passes by second printing couple 12, cam bar 76 resumes its configuration as indicated by portion 76*a* and spring 46 will bias the entire gripper bar device back to its original position as shown in FIG. 2. This will be done in area "IV" as indicated in FIG. 1. The gripper bar device then is ready to pick up another copy sheet, by its lead end, at first printing couple 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In a duplicating machine for duplicating images on both sides of copy sheets including a first printing couple for transferring a first image to a first side of a copy sheet and a second printing couple for transferring a second image to a second side of the sheet, means for handling said sheets for duplexing said images thereon, comprising:

conveyor means movable between said first and second printing couples; and means operatively associated with said conveyor means for gripping the lead end of a copy sheet issuing from said first printing couple and rotating the sheet about an axis generally parallel to the direction of movement of said conveyor means to present the second side of the sheet to said second printing couple.

2. In a duplicating machine as set forth in claim 1, wherein said gripping means include a gripper bar extending transversely of said conveyor means.

3. In a duplicating machine as set forth in claim 2, including means for rotating said gripper bar about an axis coincident with a central axis in the plane of a copy sheet engaged by said gripper bar.

4. In a duplicating machine as set forth in claim 2, wherein said conveyor means include a pair of generally parallel drive chains, and means mounting said gripper bar transversely between the drive chains for movement with the drive claims.

5. In a duplicating machine as set forth in claim 4, including cam means disposed at a predetermined location along the path of movement of said gripper bar for effecting said rotation of the gripper bar.

6. In a duplicating machine as set forth in claim 5, including cam follower means on said gripper bar mounting means and operatively associated with the gripper bar for effecting said rotation of the gripper bar.

7. In a duplicating machine as set forth in claim 6, including a pinion gear on said gripper bar and defining said axis of rotation thereof, and a ratchet gear in mesh with the pinion gear and movable by said cam follower means to effect said rotation of the gripper bar.

8. In a duplicating machine as set forth in claim 5, wherein said cam means is located along a first run of said conveyor means moving from said first printing couple toward said second printing couple, and including second cam means located along a return run of said conveyor means moving back from the second printing couple toward the first printing couple for rotating the gripper bar back to its original position for gripping a copy sheet issuing from the first printing couple.

9. In a duplicating machine as set forth in claim 1, including means disposed at a predetermined location along the path of said conveyor means for operating said gripping means to effect said rotation of the gripping means.

10. In a duplicating machine for duplicating images on both sides of copy sheets including a first printing couple for transferring a first image to a first side of a copy sheet and a second printing couple for transferring a second image to a second side of the sheet, means for handling said sheets for duplexing said images thereon, comprising:

a pair of generally parallel, endless drive chains movable along forward and return runs between said first and second printing couples;

a gripper bar for engaging the lead end of a copy sheet as the sheet issues from said first printing couple;

means mounting said gripper bar transversely between said drive chains for movement with the drive chains;

rotating means between said gripper bar and said mounting means for rotating the sheet about an axis generally parallel to the direction of movement of the drive chains to present the second side of the sheet to said second printing couple; and cam means disposed at a predetermined location along said forward run of said drive chains and operatively associated with said rotating means for effecting said rotation of said gripper bar.

11. In a duplicating machine as set forth in claim 10, wherein said rotating means includes a pinion gear fixed to said gripper bar, and a ratchet gear in mesh with the pinion gear and movably mounted on said gripper bar mounting means.

12. In a duplicating machine as set forth in claim 11, wherein said pinion gear is disposed on an axis coincident with a central axis in the plane of a copy sheet engaged by said gripper bar.

13. In a duplicating machine as set forth in claim 12, wherein said ratchet gear is connected to a cam follower engageable with said cam means for moving the ratchet gear and rotating the pinion gear.

14. In a duplicating machine as set forth in claim 10, including second cam means located along said return run of said drive chains for rotating the gripper bar back to its original position for engaging a copy sheet issuing from the first printing couple.

* * * * *